United States Patent [19]

Blakeway et al.

[11] 4,267,610

[45] May 19, 1981

[54] BODY SUPPORT

[75] Inventors: Richard S. Blakeway, 5 Yarrow Ct., Cleveland, Queensland, Australia, 4163; Stanley R. Blakeway, Stafford; Peter J. Olds, Maryborough, both of Australia

[73] Assignee: Richard S. Blakeway, Cleveland, Australia

[21] Appl. No.: 55,356

[22] Filed: Jul. 6, 1979

[51] Int. Cl.[3] ..... A61H 7/00; A61H 15/00; F01B 0/00

[52] U.S. Cl. ..... 5/60; 5/108; 5/412; 91/218; 91/327; 128/57

[58] Field of Search ..... 5/60, 66, 68, 108, 109, 5/412, 481; 128/242, 32, 33, 44, 56, , 57, 78; 91/327, 218

[56] References Cited

U.S. PATENT DOCUMENTS

| | | | |
|---|---|---|---|
| 3,464,406 | 9/1969 | Kunce | 128/57 |
| 3,882,556 | 5/1975 | Accurso | 5/108 |
| 3,889,472 | 6/1975 | Guiland | 91/218 |
| 4,070,831 | 1/1978 | Rietz | 91/218 |
| 4,154,232 | 5/1979 | Fukagawa | 128/57 |

*Primary Examiner*—Casmir A. Nunberg

*Attorney, Agent, or Firm*—Schwartz, Jeffery, Schwaab, Mack, Blumenthal & Koch

[57] ABSTRACT

A body support such as a bed, operating table or seat has a flexible top sheet secured over the sides and ends of a frame, and resting on a series of parallel resiliently deformable rollers located between the sides of the frame and supported, in turn, by a longitudinally reciprocal substantially horizontal bearer plate, which is driven back and forth causing the rollers to roll back and forth under the top sheet, thus constantly changing the main pressure areas of the body supported by the top sheet.

3 Claims, 4 Drawing Figures

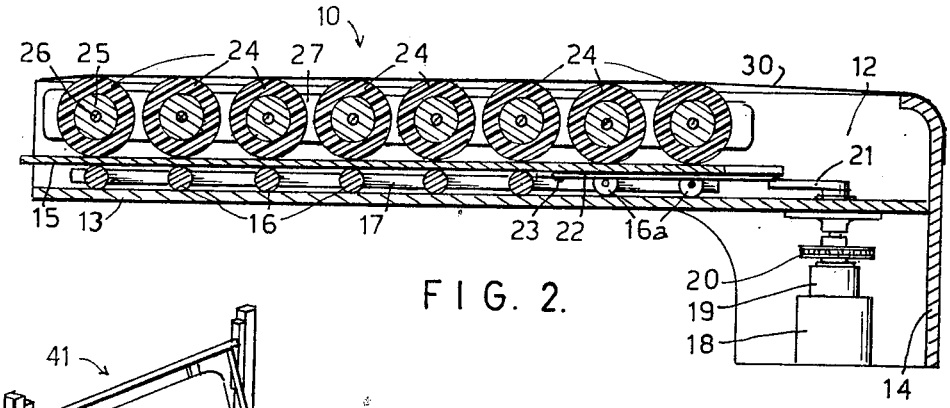
FIG. 2.
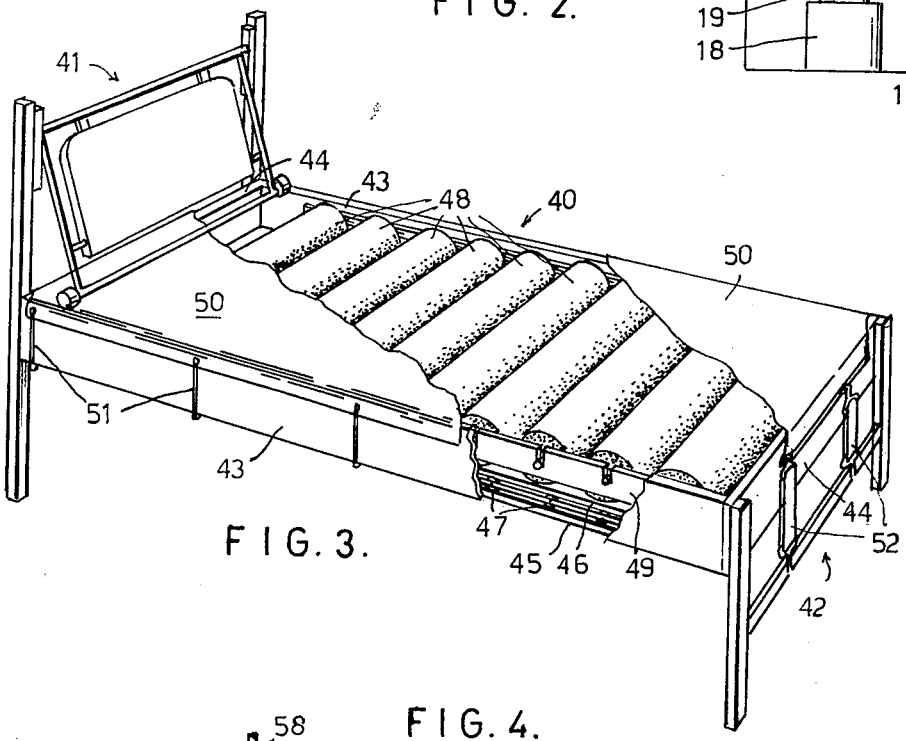
FIG. 3.
FIG. 4.
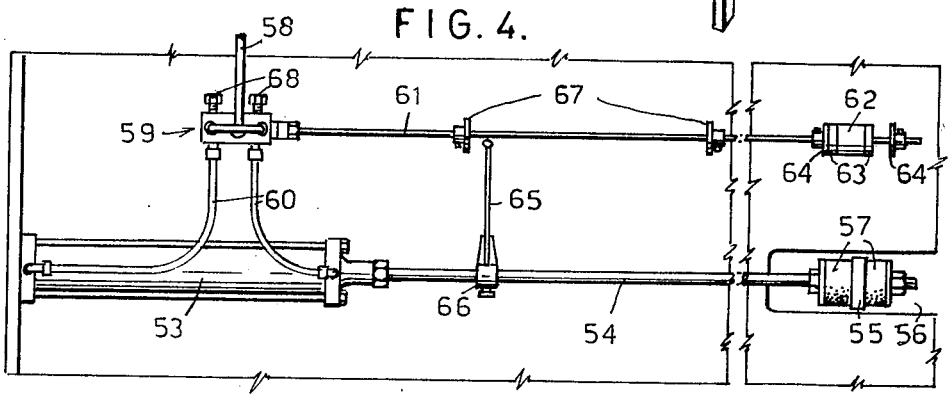

BODY SUPPORT

BACKGROUND OF THE INVENTION

This invention relates to a body support, and more particularly to a bed, operating table, vehicle seat or other structure of a like or analogous nature on which a person may have to lie or sit for a considerable time with little movement.

Hospital patients, confined to bed for long periods and incapable of, or restrained from, much movement, suffer great discomfort and may require frequent treatment to prevent, or treat, bed-sores resulting principally from restricted blood circulation at high pressure areas. Prolonged surgical operating procedures are also likely to result in impaired blood circulation of patients immobilised on operating tables, resulting in thrombosis, often with very serious consequences. Car and truck drivers, and aeroplane pilots, are likely to suffer considerable discomfort when required to remain seated with little movement for long periods, again due to local restriction of blood circulation.

BRIEF SUMMARY OF THE INVENTION

The present invention has been devised to overcome or greatly minimise there effects of prolonged and unrelieved localised pressures on the body by providing a body support, such as a bed, or an operating table, or a vehicle seat, which is of such novel and improved construction as to promote rather than impair blood circulation and relieve localised pressures on the body of a user of the support.

Accordingly, the invention resides broadly in a body support such a bed, operating table or vehicle seat, including a base frame, a substantially horizontal bearer member mounted on the base frame for reciprocal movement longitudinally with respect to the base frame, a series of parallel resiliently deformable rollers arranged transversely on, and supported by, the bearer member, a flexible top sheet secured on the base frame over and in contact with the rollers, and means for reciprocating the bearer member to cause the rollers to roll back and forth in unison between it and the top sheet. Other features of the invention will become apparent from the following description.

BRIEF DESCRIPTION OF THE DRAWINGS

In the drawings:

FIG. 2 is a longitudinal sectional view of the body support shown in FIG. 1, FIG. 3 is a partly broken-away perspective view of a bed according to the invention, and FIG. 4 is a partly broken-away view from below of the reciprocating mechanism of the bed shown in FIG. 3.

DETAILED DESCRIPTION OF THE PREFERRED EMBODIMENTS

Figure 1:
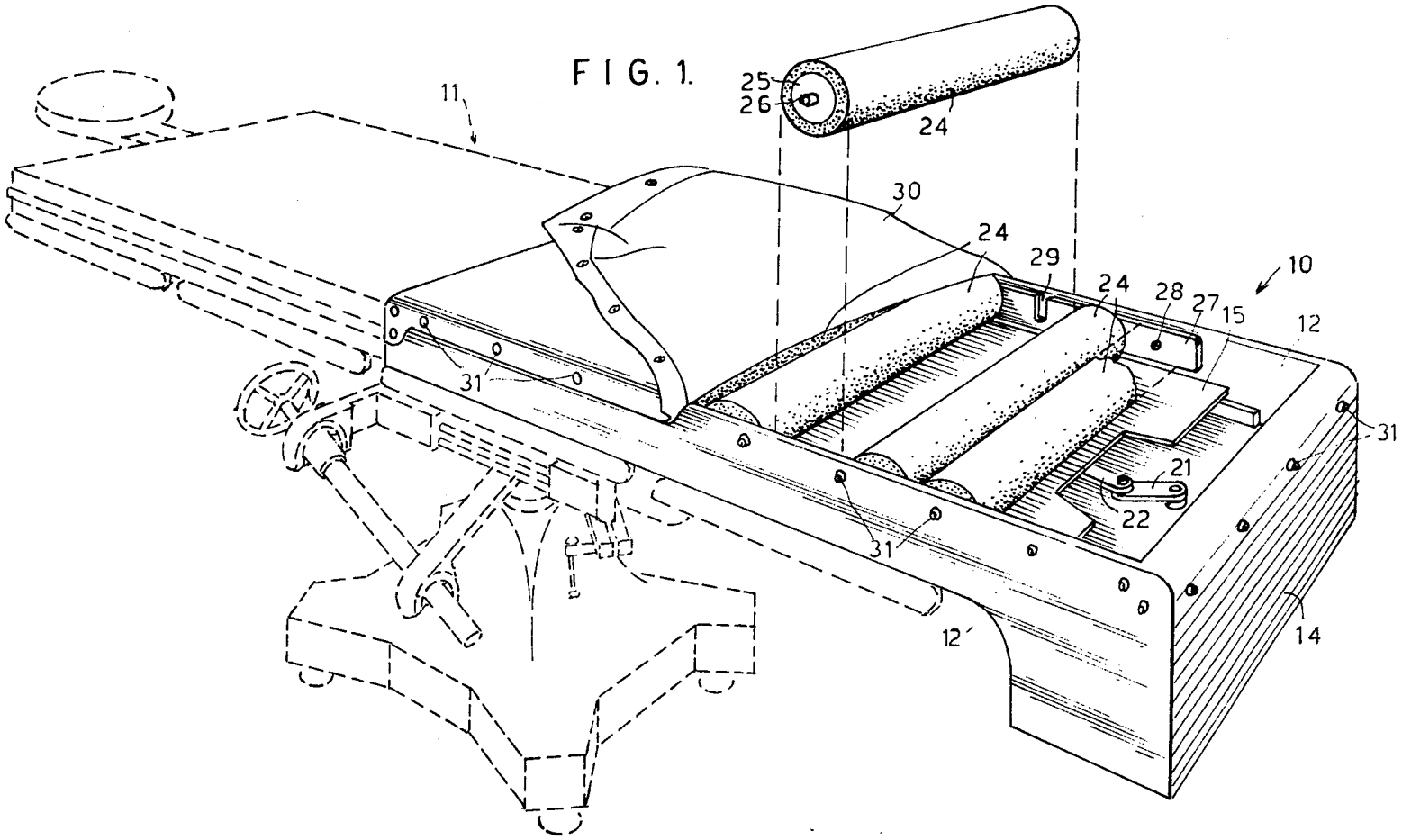
FIG. 1 is a perspective view of a body support according to the invention applied to an operating table shown in broken outline.

Referring initially to FIGS. 1 and 2, a body support unit, indicated generally at 10, is applied to an otherwise generally conventional hospital operating table indicated in broken outline at 11 in FIG. 1. The body support unit is installed in substitution for the body supporting part of the operating table which normally supports the buttocks and legs of a patient, and it includes two parallel upright sides 12 rigidly interconnected by a rectangular base plate 13 and an end piece 14.

Above and parallel to the base plate 13 is a reciprocating plate 15, supported by a series of parallel transverse bottom rollers 16, which are rotatably mounted between a pair of parallel side bars 17, and are free to roll on the base plate 13 and against the underside of the reciprocating plate 15. The two bottom rollers **16*a* nearest to the end piece 14** have their middle parts reduced in diameter.

The reciprocating plate 15 is reciprocated by an electric motor 18 acting through a reducing gearbox 19 and a sprocket and chain drive 20 to drive a shaft carrying at its under end a crank 21, a connecting rod 22 being pivoted at one end to the crank, passing closely under the nearer end of the reciprocating plate 15 and over the reduced-diameter middle parts of the rollers **16*a*, and pivoted at its other end to the reciprocating plate at 23**.

A series of transverse resilient rollers 24 are supported in spaced parallel arrangement on the reciprocating plate, each of these having a cylindrical sleeve of resiliently deformable and compressible material such as foam plastic secured about a cylindrical core 25 fixed on a coaxial shaft 26. The ends of the roller shafts 26 are engaged in a pair of parallel side members 27 which may be of plywood for example, the axles of the two end rollers being freely rotatable in round holes 28 in the side members, those of the other rollers being engaged in slots 29 extending downwardly from the tops of the side members. The rollers are thus maintained in equally spaced parallel relationship, and free to roll in unison back and forth over the reciprocating plate 15.

A cover sheet 30, of any suitable fairly heavy fabric material is fitted over the tops of the resilient rollers 24, its sides and an end being brought down over the upper parts of the side 12 and end piece 14 of the unit and releasably held by press fasteners 31.

When a patient is on the operating table, the motor 18 is operated to move the reciprocating member 15 back and forth, travelling easily on the bottom rollers 16, and the resilient rollers 24 are rolled back and forth in unison between the reciprocating member 15 and the cover sheet 30. The legs of the patient, then, are subjected to a massaging effect stimulating the flow of blood through the vascular system and, it is believed, minimising the likelihood of thrombosis.

FIGS. 3 and 4 illustrate the application of the invention to a hospital bed, a body support unit 40 having a conventional hospital bed head 41 secured to one end and a bed foot 42 secured to the other end. The unit 40 includes a rectangular box-like structure of sides 43, ends 44 and base plate 45, a rectangular reciprocating plate 46 being supported by bottom rollers 47 in longitudinally movable manner between the sides 43. Upon the reciprocating plate 46, a series of resilient rollers 48 similar to the rollers 24 before described are mounted rotatably between a pair of side members 49, again generally similar to the side members 27 described with reference to FIGS. 1 and 2. A cover sheet 50 is fitted over the box-like structure and the resilient rollers 48 and is retained by clips 51 and tensioned by rubber bands 52 stretched between the foot of the sheet 50 and the bed foot 42.

A hydraulic mechanism shown in FIG. 4 is employed in this embodiment to move the reciprocating plate 46 back and forth. This apparatus includes a double-acting hydraulic cylinder 53 which is fixed longitudinally under the base plate 45, its piston 54 extending towards the foot of the bed. A bracket 55 secured to and extending downwardly from the foot end of the reciprocating plate, and passing through a slotted hole 56 in the base plate 45, is engaged between a pair of resilient rubber or like pads 57 secured on the piston 54.

Hydraulic fluid under pressure is fed through a line 58 to a control valve device 59 under the base plate and connected by fluid lines 60 to opposite ends of the hydraulic cylinder 53. The control valve device 59 is of well-known type having an internal spool valve mounted on a stem 61 by which it can be moved slidably to either of two positions for directing the hydraulic fluid under pressure to either end of the cylinder 53. The stem 61 is prolonged and is slidable through a bearing 62 secured under the base plate 45. A small permanent magnet 63 is fitted to each end of the bearing 62. A pair of steel collars 64 are mounted adjustably on the valve stem 61, to both ends of the bearing 62 so that one of the collars 64 is against, and held by, one of the magnets 63 when the valve stem has been moved to bring the valve to one of its alternative positions, and the other collar 64 is brought against, and held by, one of the magnets 63 when the valve stem has been moved to its other position.

A resilient leaf-spring striker 65 extends radially from a collar 66 secured adjustably on the hydraulic cylinder piston 54 and is arranged to engage one of a pair of stop collars 67 mounted adjustably on the valve stem 61 as the piston approaches the end of each stroke. As the stroke of the piston continues, the pressure exerted by the striker 65 on the engaged stop collar 67 increases until it is sufficient to overcome the hold of a magnet 63 on an adjacent steel collar 64 with the result that thereupon the valve stem 61 is moved rapidly to bring the other steel collar against the other magnet, the valve device 59 therefore rapidly moving to reverse the flow of the hydraulic fluid to the cylinder 53. Adjustment screws 68 on the control valve device 59 may be used to vary the rate of flow of hydraulic fluid to either end of the hydraulic cylinder, and thus vary the speed of the stroke of the piston 54 in either direction, and the length of the stroke may be determined by the location of the adjustable stop collars 67. Such a hydraulic drive, in addition to being adjustable, is advantageous in that it may be very quiet in operation.

A body support according to the invention will be found to be very effective in achieving the objects for which it has been devised. The main pressure areas of a person using such a support are relieved with the motion of the resilient rollers under the cover, and circulation of blood through such areas is promoted. The cover sheet can be easily removed for cleaning, as also may any of the resilient rollers. In some circumstances, for the comfort of a patient, one or more of the rollers may be removed to relieve pressure on specific areas of the body.

We claim:

1. A body support including:

a base frame, a substantially horizontal bearer member mounted on the base frame for reciprocal movement longitudinally with respect to said base frame, a series of parallel resiliently deformable rollers arranged transversely on, and supported by, said bearer member, a flexible top sheet secured on said base frame over and in contact with said rollers, and means for reciprocating said bearer member to cause said rollers to rock back and forth in unison between said bearer member and said top sheet.

2. A body support according to claim 1 wherein:

said base frame includes a substantially horizontal base plate, and said bearer member is supported above and parallel to the said base plate by a series of parallel transverse bottom rollers.

3. A body support according to claim 1 wherein the means for reciprocating said bearer member includes:

a double-acting hydraulic cylinder connected to said base frame, its piston connected to said bearer member, a slidable control valve connected in the hydraulic circuit of the hydraulic cylinder and adapted to be moved by a valve stem to either of two alternative positions to reverse the action of said cylinder, magnetic means for releasably retaining said valve in either of its two said positions, two stops mounted adjustable on said valve stem, and a resilient striker on said hydraulic cylinder piston, adapted, when said piston nears the end of a stroke, so to interact with one or other of said stops as to overcome the magnetic means and move said valve to its alternative position.

* * * * *